United States Patent [19]

Lind

[11] Patent Number: 5,004,229

[45] Date of Patent: Apr. 2, 1991

[54] PORTABLE EXERCISE DEVICE

[76] Inventor: Charles F. Lind, 2210 E. Sherwood Rd., Arlington Hts., Ill. 60004

[21] Appl. No.: 266,642

[22] Filed: Nov. 3, 1988

[51] Int. Cl.[5] ..... A63B 21/00

[52] U.S. Cl. ..... 272/127; 272/93

[58] Field of Search ..... 272/127, 114, 96, 93, 272/70.3

[56] References Cited

U.S. PATENT DOCUMENTS

| | | | |
|---|---|---|---|
| 1,383,928 | 7/1921 | Gassette | 272/96 |
| 4,826,151 | 5/1989 | Nuredin | 272/93 |

FOREIGN PATENT DOCUMENTS

| | | | |
|---|---|---|---|
| 0634093 | 7/1936 | Fed. Rep. of Germany | 272/127 |
| 0663233 | 7/1938 | Fed. Rep. of Germany | 272/127 |
| 2213443 | 10/1973 | Fed. Rep. of Germany | 272/127 |
| 1040907 | 12/1953 | France | 272/114 |

*Primary Examiner*—Stephen R. Crow

[57] ABSTRACT

The disclosed exercise device has a frame, wheels connected to the frame operable to support the frame for movement along a generally flat horizontally disposed support surface, and structures the frame includes foot retainers to receive and hold the legs of the exerciser, generally at or near the feet, relative to the frame, with the exerciser's toes generally pointing in the same direction. The exercise device is used by the exerciser assuming a substantially rigid bridged position on a generally horizontal support surface, supported at the head end primarily on his/her hands and at the feet end primarily on his/her legs via the exercise device. The exerciser then can move his/her body at the waist and/or hips and/or knees and/or elbows and/or shoulders, with the hands stationary, to move the frame device along the support surface toward and away from the hands, or moving the hands along hand over hand on the support surface, to move the frame device along the support surface in following the hands.

8 Claims, 4 Drawing Sheets

FIG. 7
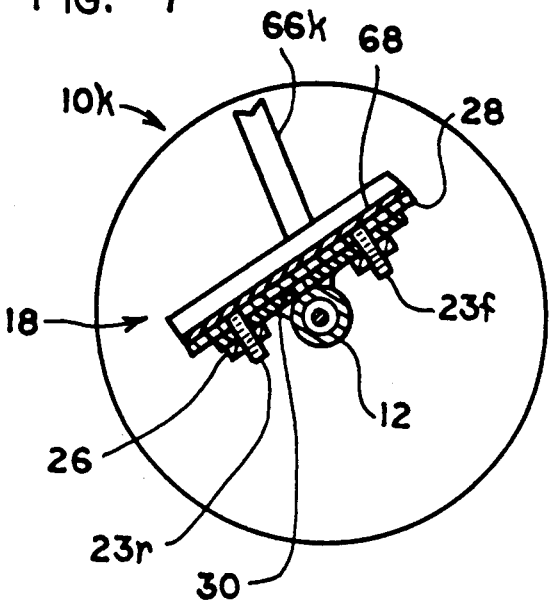
FIG. 6
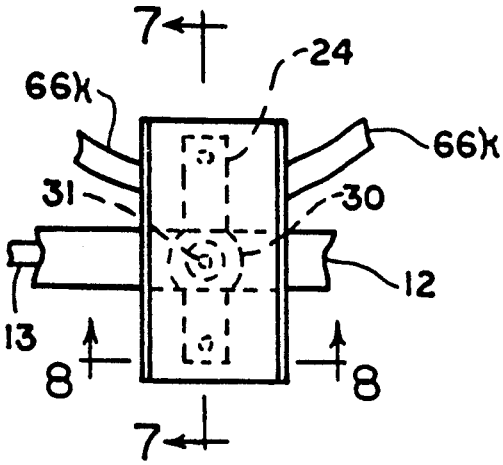
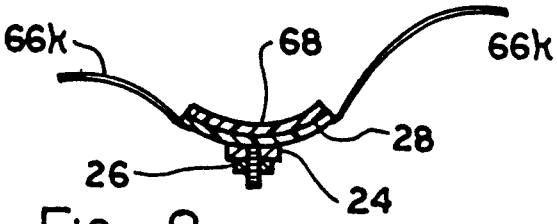
FIG. 8
FIG. 19
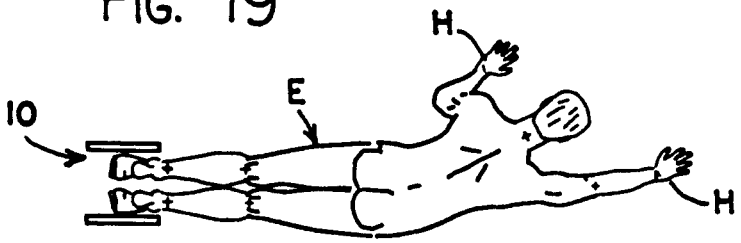
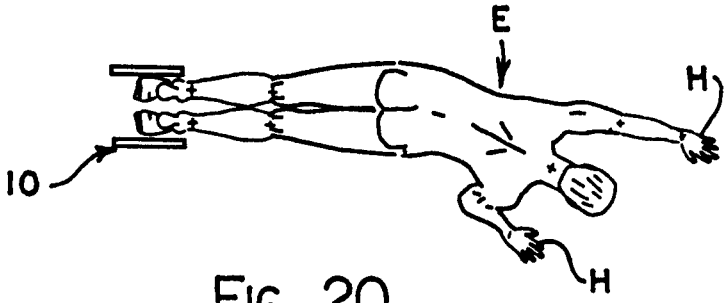
FIG. 20

FIG. 21
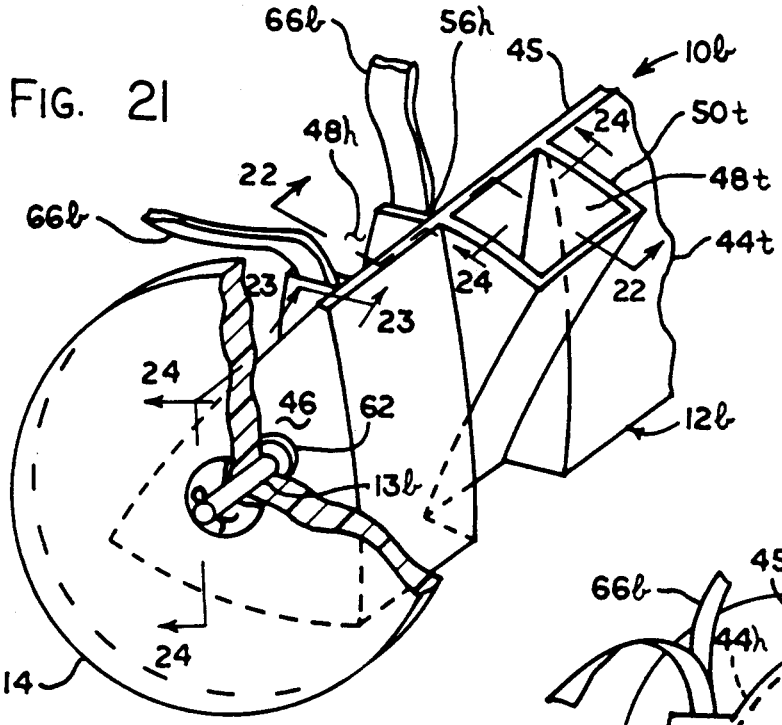
FIG. 22
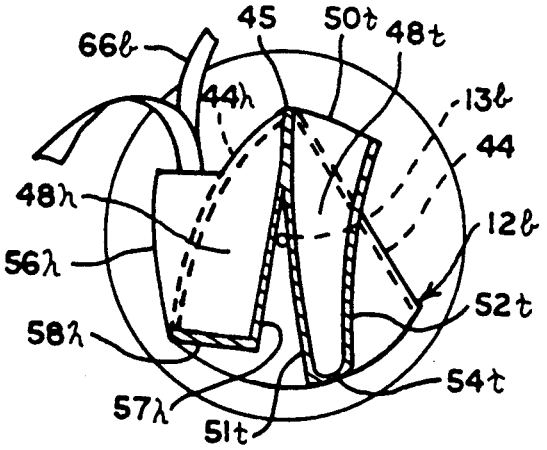
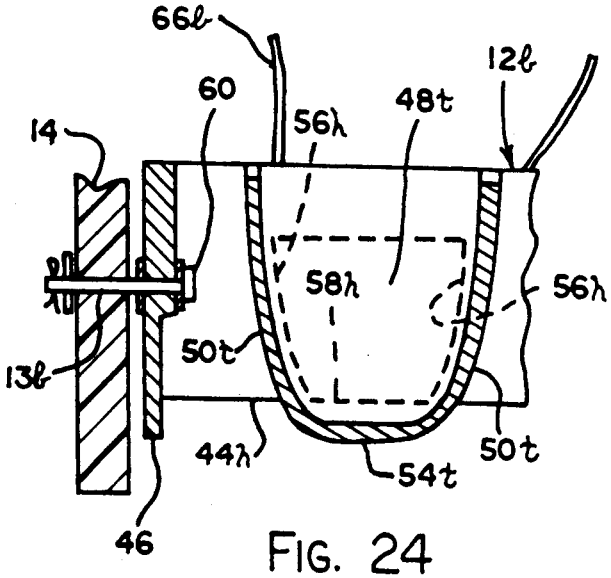
FIG. 24
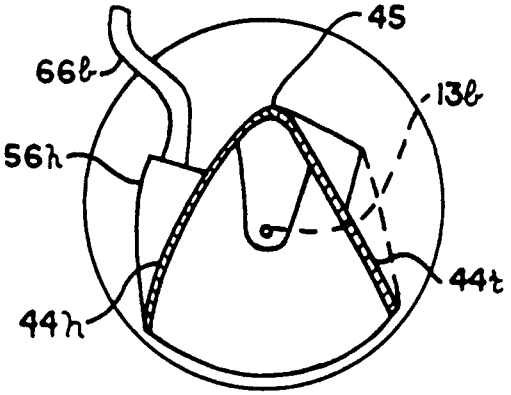
FIG. 23

PORTABLE EXERCISE DEVICE

FIELD OF THE INVENTION

This invention relates to a portable exercise device effective to tone up many muscle groups of the body, including the arms, legs, back abdonimal, neck and hands.

BACKGROUND OF THE INVENTION

Many portable exercise devices are effective to tone up specific muscle groups of the body; but few, if any, are effective to tone up many or most muscle groups. By contrast, many stationary exercise devices are effective to tone up many muscle groups of the body; but these devices typically are big and costly. Moreover, such stationary devices have many separate stations each directed to tone certain groups only, so that to achieve toning of many muscle groups, the exerciser must exercise at many of the different stations. Also, most such devices use pneumatics, springs or weights to provide resistance for the exerciser to move throughout specific motions. This means that physical components of different sizes and/or capacities would be needed to impose different resistances suited for different exercisers, in part depending on the size and strength of each exerciser. The needed inventory of such physical components may increase the costs and reduce the appeal, overall, of such an exercise device.

SUMMARY OF THE INVENTION

This invention relates to a portable exercise device that relies on the exerciser's own body weight to provide most of the resistance aganinst self-properlling movement of the device during use along a generally flat horizontally disposed support surface, and when used in different modes of exercise, is effective to stress may of the basic muscle groups, including the arms, legs, back, abdonimal, neck and hands of the exerciser.

The basic object of the present invention is to provide a portable exercise device that is economical to make and easy to use, according to different modes effective to dynamically stress and tone many of the exerciser's muscle groups, such as the lower back and side control muscles, in manners not currently available except possibly on large costly stationary devices.

To achieve this and other objects, the present invention provides an exercise device having a frame, wheels connected to the frame operable to support the frame for movement along a generally flat horizontally disposed support surface, and means on the frame to receive and hold the legs or feet of the exerciser fixed relative to the frame, in generally adjacent disposition and with the exerciser's toes pointing in approximately the same direction. The exerciser can initially assume a substantially rigid bridged position on the support surface, being supported at the head end on his/her arms and hands and at the feet end on his/her legs, via the legs or feet carried on the execise device. The exerciser can then move his/her body at the waist and/or hips and/or knees and/or elbows and/or shoulders, with the hands being held stationary on or also moving hand over hand along on the support surface, to move the exercise device along the support surface, all the while maintaining his/her body in the bridged position.

BRIEF DISCRIPTION OF THE DRAWINGS

Further objects, advantages and features of the present invention will appear from the following disclosure and description, including as a part thereof the accompanying drawings, in which:

FIGS. 6 and 7 are views that correspond to FIGS. 2 and 3, respectively, except having different means thereon for holding the exerciser's legs generally between the feet and knees;

FIG. 8 is a fragmentary section, taken generally along line 8—8 in FIG. 6;

FIGS. 19 and 20 are top plan views of an exerciser using the device of FIGS. 1–3 according to yet another mode of exercise;

FIG. 21 is a persepective view of another embodiment of the exercise device, illustrating only the near side half approximately of the device; and FIGS. 22, 23 and 24 are fragmentary sections, taken generally from lines 22—22, 23—23 and 24—24, respectively, in FIG. 21.

DETAILED DESCRIPTION OF ILLUSTRATED EMBODIMENTS

Figure 1:
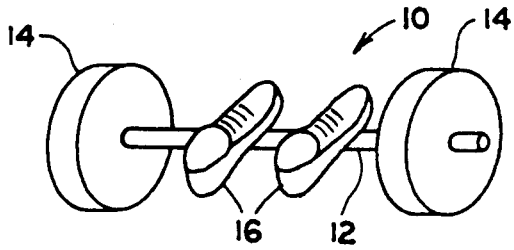
FIG. 1 is a perspective view of a first embodiment of the inventive exercise device, having shoes for holding the exerciser's feet relative to the frame of the device.
Figure 10:
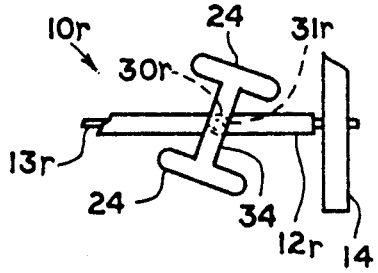
FIG. 10 is a view that corresponds to FIG. 2, except showing different means thereon for holding the exerciser's feet relative to the frame.
Figure 3:
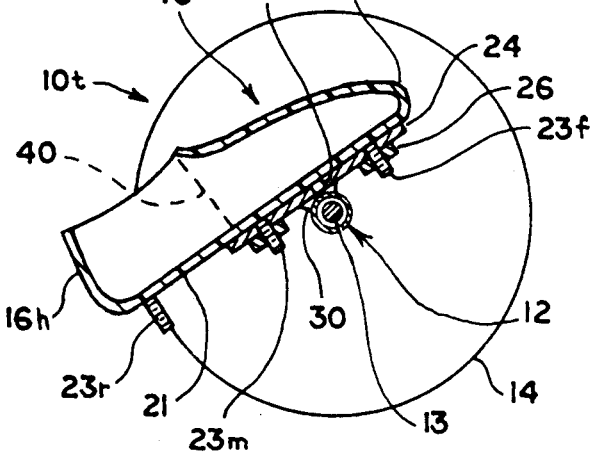
FIG. 3 is a fragmentary section, taken generally along line 3—3 in FIG. 2.
Figure 2:
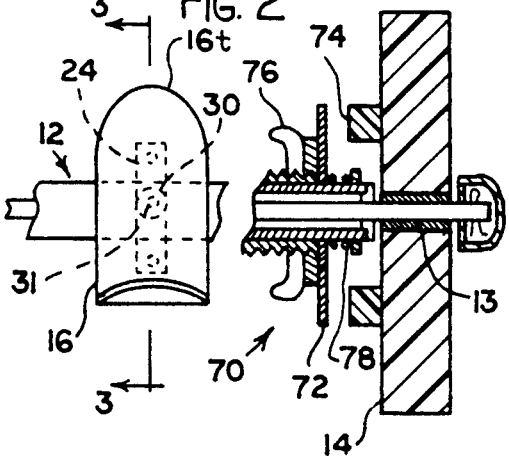
FIG. 2 is an enlarged fragmentary view, in part in section taken generally through the wheel axle in the device of FIG. 1 and in part in plan, showing the shoes in one operative position.

The illustrated exercise devices 10 of FIGS. 1, 10*t* of FIGS. 2 and 3, 10*h* of FIGS. 4 and 5, 10*k* to FIGS. 6–8, 10*r* of FIG. 10, and 10*b* to FIGS. 21–24 are lightweight and vary portable, and allow an exerciser "E" (see FIGS. 10–19) to perform many different exercises on a generally flat horizontally disposed support surface "S", typically the floor when indoors or the ground when outdoors. Each of the exercises is performed basically from a bridged position, where the exerciser "E" is supported at the head end on his/her arm(s) "A" and hand(s) "H" and at the feet end on his/her legs, via the exercise device at the feet "F" or between the feet and knees "K", while all other portions of the exerciser are elevated above or off of the support surface. The exercise device can be rolled along the support surface "S" generally toward and away from the supporting hand(s), while the exerciser is in the bridged position, when the exerciser moves his/her body at the waist and/or hips and/or knees and/or elbows and/or shoulders, with the hands being held stationary on or also moving hand over hand along on the support surface.

The exercise devices 10 (FIG. 1), 10*t* (FIGS. 2 and 3), 10*h* (FIGS. 4 and 5) , and 10*k* (FIGS. 6–8) are closely related and will be disclosed first. These exercise devices each includes a tubular cross frame 12, an axle 13 carried by the frame, and a pair of laterally spaced wheels 14 connected rotatably to the axle 13, operable to rotate relative to the frame. The device 10 has means for securing shoes 16 to the frame means 12 (device 10*t* in FIGS. 2 and 3, and device 10*h* in FIGS. 4 and 5) operable to receive and hold the exerciser's feet "F"; or for securing separate trough-like forms 18, instead of the shoes 16 (devices 10*k* in FIGS. 6, 7 and 8) operable to contact and support the lower part of the exerciser's legs, between the knees "K" and feet "F".

Figure 5:
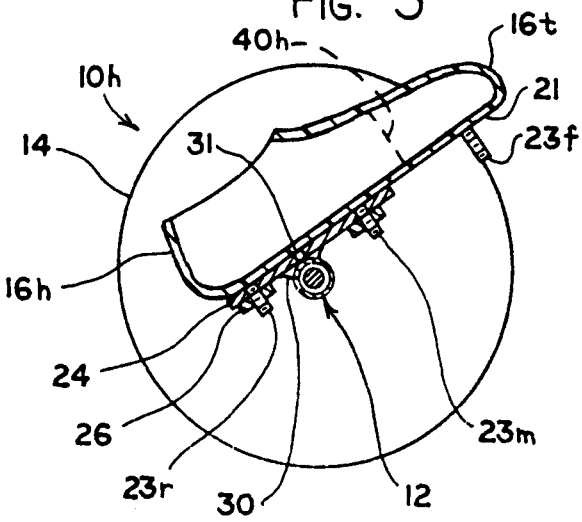
FIGS. 4 and 5 are views that correspond to FIGS. 2 and 3, respectively, except having the shoes in another operative position.
Figure 4:
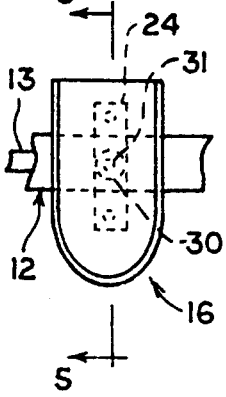

The shoes 16 each may have a sole 21, and spaced bolts 23*f*, 23*m* and 23*r* may project therefrom; and the frame 12 may have a plate 24 with two holes therein, to receive two of the adjacent bolts: 23*f* and 23*m* in FIGS. 2 and 3, and 23*m* and 23*r* in FIGS. 4 and 5. Nuts 26 may be threaded onto the bolts for holding each shoe tightly against its plate 24. This connection allows the shoes 16 to be secured to the frame 12 in either of the two setting of FIGS. 3 and 5.

The trough-like forms 18 may have a plate 28 with only spaced bolts 23*f* and 23*r* porjected therefrom, to fit in the plate holes in a single setting and be held in place by nuts 26, as illustrated in FIG. 7.

Figure 17:
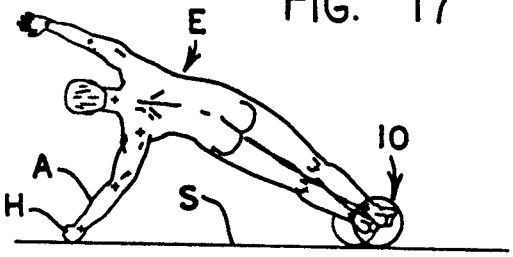
FIG. 17 is an elevational view of an exerciser using the device of FIG. 9 according to another mode of exercise.

Each plate 24 may be secured to the frame 12 via a bearing boss 30 and headed pin 31, operable to allow limited plate rotation relative to the frame, about an axis normal to the axle 15, while remaining in the plane of the upper face of bearing boss, which will be made generally parallel to the axle. This allows the feet "F" be rotated to be normal to the axle 15 (FIGS. 2 and 4) or to be more in line with or even parallel to the axle (see FIG. 9), and allows to the exerciser to do sideways modes of exercise, as illustrated in FIG. 17. If true parallelism to the feet and axle means is desired, the wheels 14 generally will be laterally separated enough so that the feet may be aligned end-to-end along the axle, one foot in front of the other, without the feet touching the wheels.

An alternative execrcise device 10*r* is shown in FIG. 10, where each plate 24*r* may be rigidly secured to opposite ends of a mounting bar 34, to form a rigid assembly in the form of a "H", and the mounting bar 34 in turn would be pivoted at its approximate midpoint between the plates 24*r* to a single bearing boss 30*r* and pin 31*r* (like boss 30 and pin 31) except centered on the frame 12*r* approximately between the wheels 14 (only one wheel being illustrated in the figure). This allows limited mounting bar rotation about the bearing boss 30*r*, relative to the frame 12*r*, about an axis normal to the axle means while remaining in a plane generally parallel to the axle means. The feet-holding means or shoes (not shown in the figure) in turn may be secured to the plates 24*r*, as in FIGS. 3 or 5, or with a single setting somewhat centered front-to-rear relative to the mounting bar 34.

When using this embodiment, the exerciser could face toward or away from the support surface, or may face generally sideways (as is illustrated in FIG. 17); while in this sideway mode, the exerciser's feet (not shown) would become vertically separated, one above the other, instead to being laterally separated and side-by-side or end-to-end generally at common horizontal elevations. This modification may be advantageous at it would allow the exercise device 10*r* to be of a somewhat more compact overall width, even with wheel sizes and feet spacings similar to those used in the basic exercise device 10.

The exercise device 10*b* of FIGS. 21–24 has a one-piece cross frame 12*b* with longitudinally spaced cross walls 44*t* and 44*h* meeting along the upper edge 45, separate end walls 46, and a pair of laterally separated feet holding forms 48*t* and 48*h* within the cross walls (although only a single example of each form is illustrated). Each toe-holding form 48*t* includes laterally spaced side walls 50*t*, sole wall 51*t* and wall 52*t* longitudinally spaced forewardly therefrom, and toe closure wall 54*t*, each connected together at respective corner edges, to porvide that the toe-holding from 48*t* opens upwardly, Each heel-holding form 48*h* includes laterally spaced walls 56*h*, sole wall 57*h*, and heel closure wall 58*h*, each connected together at respective corner edges, to provide that the heel-holding form 48*h* opens both upwardly and rearwardly away from the device.

The toe-end of each of the exerciser's feet may be inserted into the respective top-open from 48*t*, with the sole of each foot being adjacent the sole wall 51*t* and the toes adjacent the toe closure wall 54*t*, for doing one mode of exercise; while the heel-end of the exerciser's feet may be positioned in the top and rearwardly open forms 48*h*, with the sole of each foot adjacent the sole wall 57*h* and the heel adjacent the heel closure wall 58*h*, for doing another mode of exercise.

Separate axles 13*b* may be secured to the end walls 46, each having a headed end threaded part way in from the head 60 to allow a cooperating nut 62 hold the axle securely to the intervening wall. A pair of wheels 14 may be connected rotatably to the smooth outer ends of the axles 13*b* operable to support the frame 12*b* for rolling movement along the support surface "S".

As is illustrated in FIG. 22, the toe-holding forms 48*t* are defined generally on one side of the cross frame 12*b* (relative to the axles 13*b* for the wheels 14), and the heel-holding forms 48*h* are defined on the opposite side of the cross frame. The toe-holding forms 48*t* and the heel-holding forms 48*h* may be somewhat longitudinally aligned, but because the size of each may differ, the laterally spaced side walls 50*t* and 56*h*, and toe and heel closure walls 54*t* and 58*h* need not be aligned longitudinally, as illustrated.

Straps may be provided on the frame 12 adapted to be wrapped and secured around the exerciser's foot or leg, for making the connection between the exercise "E" and the exerciser device firm and tight. For example, straps 66*k* are illustrated in the excercise device 10*k* generally at each trough-like plate 28, adapted to be secured around the lower part of the exerciser's legs, between the knees "K" and feet "F". In this same device, pads 68 may be provided on the trough-like forms 18, to add to the exerciser's comfort when the connection has been made. Straps 66*b* are also illustrated on the frame 12*b* adjacent each heel-holding form 48*h* on the device 10*b*, operable to be wrapped around the exposed instep of the exerciser's feet for making the heel connection firm and tight.

The disclosed two wheel exercise device is unstable by itself, and the connections to or with the exerciser's feet or legs provide the only means stabilizing the device. This may be done by making the connections firm and solid relative to the exerciser, as with the shoe or trough means of FIGS. 1–5 and 6–8. However, by using the geometry of the components in the connections, a stablizing couple may be created between the feet and the frame tending to reduce the need for rigid connections.

Thus, by having the toe-end **16*t* or heel-end 16*h*, or toe closure wall 54*t* or heel closure wall 58*h* located close to the support surface "S", without touching it, the portion of the exerciser's weight carried by the device will lie below the axle, to establish a couple between the exerciser's feet and frame biasing the frame to a stable position with the toe-end 16*t* or heel-end 16*h*, or toe closure wall 54*t* or heel closure wall 58*h* located close to the support surface "S". Moreover, the shoe soles 21, and sole wall 51*r* or 57*h***, line up approximately tangentially of or radially close to the rotational axis to the wheels. The shoes typically will be in side-by-side disposition, with the exerciser's toes "T" pointing substantially in the same direction.

Generally, because of the length of the foot that can be fitted into the toe-holding forms **48*t***, this connection is sufficiently stable even without using straps.

By way of example, the shoes 16 may be spaced apart along the cross frame, on perhaps 3–18 inch centers, giving as little as between one inch clearance between the shoes and up to many inches of clearance between the shoes; and each shoe center mounting may be spaced inwardly from its adjacent wheel between possibly 2–15 inches. The exerciser's feet "F" adjacent the support surface "S", at the toes or at the heels, may be elevated above the support surface by an inch or less, and the wheels may be of 5–20 inch diameter. In the illustrated device **10*t* of FIGS. 2 and 3, the toes 16*t* are contained within an imaginary cylinder extended through the peripheries of the wheels 14 and the heels 16*h* are shown projected beyond this same imaginary cylinder; while in device 10*h* of FIGS. 4 and 5, the heels 16*h* are contained within the imaginary cylinder extended through the peripheries of the wheels 14 and the toes 16*t*** are shown projected therebeyond. These orientations will occur when using wheels sized smaller than the exerciser's feet.

Instead of having an adjustable connection between the shoes and frame, as illustrated in the devices **10*t* and 10*h*, larger wheels 14 may be used, such as possibly 15–20 inches in diameter, to be larger than the length of the shoes, to allow the shoes to be secured somewhat centered relative to the frame 12** by means of nonadjustable connections, while yet having both appropriate toe and heel clearances.

Also, instead of having an adjustable connection between the shoes and frame, as illustrated in the devices **10*t* and 10*h*, the shoes may be nonadjustably connected to the frame to provide an exercise device sized the same as the device of 10*t* or 10*h*, with the same toe or heel clearance; except when once formed, it would allow only the use of the modified exercise device in the singular manner of either the device 10*t* or the device 10*h*. Moreover, as the needs of the shoes accordingly might also vary, half-shoes may be used instead of the illustrated full shoes. Thus, half-shoes comprising only those parts illustrated forwardly of the dashed line 40*t* in FIG. 3, would suffice in the device 10*t*; while half shoes comprising only those parts of the shoes illustrated reawardly of the dashed line 40*h* in FIG. 5, would suffice in the device 10*h***.

To vary the difficulty of using the device even further, a friction brake 70 (see FIG. 2) may be made on the device, to change the ease at which the braked wheel 14 may be rotated. Thus, a brake disc 72, nonrotatably keyed to the frame 12, would be mounted to move axially toward and away from the wheel 14 and into braking contact against a cooperating annular brake face 74 on the wheel itself. The disc 72 may be moved by a wing nut 76 screwed onto a threaded section of the frame 12, against the bias of a compression spring 78, into braking contact against the brake face 74. The tightened brake 70 would hinder easy wheel rotation, making all exercises requiring movement of the braked exercise device along the floor, more difficult to do, compared to the free wheeling exercise device.

In the illustrated embodiments of FIGS. 1–5, the shoes 16 may be in the form of actual shoes, having padded insides (not shown), to have the exerciser use the device in bare or stocking-covered feet; or the cooperating shoes may be in the form of rigid forms, such as of molded plastic, sized to fit the bare or stocking-covered feet, or of a size larger than the exerciser's shoes, to have the exerciser insert his/her shoed feet into the forms to hold his/her feet relative to the device.

FIGS. 17, 19 and 20 show the exerciser's hands "H" directly against the support surface "S", while FIGS. 11–16 and 18 show the exercirser's hands gripping and/or rested on pushup bars "B" of conventional construction, which in turn are disposed on the suppot surface. The exerciser may find it easier to use these pushup bars "B", as it reduces wrist stress and it elevates the shoulders slightly higher above the support surfaces which will shift the exerciser's center of gravity slightly toward the feet-end, to reduce the load carried by the arms and hands. On the other hand, for more difficult efforts, the execiser can support the head-end load on his-her fingertips, in the same manner as doing fingertip pushups, or on his/her knuckles with closed or partly closed fists.

OPERATION OF THE INVENTION

Just some of the various exercises that the exerciser "E" can do with the disclosed devices are illustrated in FIGS. 11–20, each evolving from the bridged position with the device supporting the feet-end of the exerciser's body and the extended arms and hands supporting the head-end. Thus, many muscle groups must be contracted or stressed merely to establish and maintain the bridged position, including the back, abdominal, leg, shoulder, arm, wrist, hand, and neck muscles, etc.; and the force is automatically related to the weight of the exerciser.

The bridged position can be established with the exerciser generally: (1) facing toward the support surface (FIGS. 11–13, 19 and 20); (2) facing away from the support surface (FIGS. 14–16); or (3) facing sideways or in the direction of the support surface (FIG. 17).

Exercise device **10*t* is used primarily with the exerciser "E" facing toward the support surfaces "S"; while the exercise device 10*h* is used primarily with the exerciser facing away from the support surface; although the pivoted shoe support will allow the devices to be used with the exerciser facing along or parallel to the support surface. Exercise devices 10*k* and 10*b* can be used with the exerciser facing toward or away from the support surface; while exercise devices 10***r* can be used in all three ways.

With the muscles already contracted isometrically in maintaining the bridged position, the exerciser can then manipulate his/her body to have the same muscle contractions amplified or reduced, or different muscle contractions generated, all under dynamic condition incidental with the body movements. Thus, the exerciser may bend or flex at the waist and/or hips and/or knees and/or shoulders and/or elbows, with the hands stationary on or also moving along on the support surface, one hand after the other upon movement at the his/her shoulders, to move the wheeled exercise device along the support surface and/or toward and away from his/her supporting hand(s), shifting the bridged separation to dynamically change and/or and other muscle contractions. For maximum benefit, the exerciser would repeat the exercise movements over and over as a series of repetitions.

Figure 11:
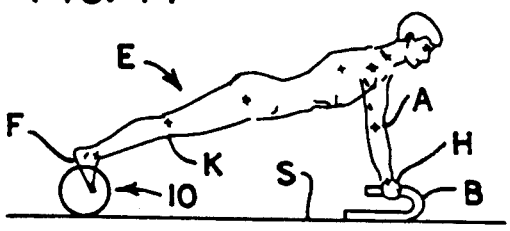
FIGS. 11–13 are elevational views of an exerciser using the device of FIGS. 2 and 3 according to different first modes of exercise.

Starting from the bridged position of FIG. 11, the exerciser's back can be straight and almost parallel to the floor and the arms can be fully extended away from the body and directed substantially at right angles relative to the support surface "S", to have a stable position with a near maximum separation between the device and the exerciser's hands. With the separation between the device and the hands, the arms will support approximately 50–75% of the body weight, while the feet via the device will support the balance of the body weight.

One basic exercise to do from the bridged position of FIG. 11 then is a push-up, by bending at the elbows to lower the straight and rigid body close to the support surface "S" (this position is not shown). However, as the device can roll along the floor, the shoulder stablization muscles must overcome this potential for the device to roll and must dynamically hold the device stationary in keeping the shoulders generally aligned vertically over the hands; and thus work harder than for doing conventional push-ups.

Figure 12:
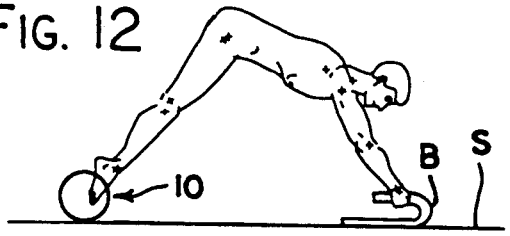
Figure 13:
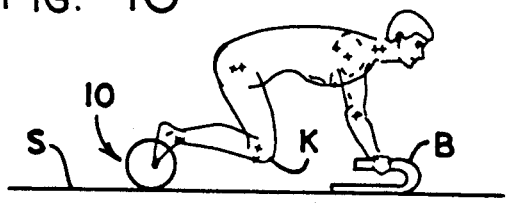

Another exercise that one can do is to draw the device closer to the exerciser's hands, by bending or flexing at the waist and/or hip joints, while keeping the knees straight (see FIG. 12); and/or by bending or flexing at the waist and/or hip joints and knees (see FIG. 13). Each of these can be done while keeping the arms straight and/or flexing or extending the upper arms slightly at the shoulders to angle them relative to the body and/or out of being normal to the support surface. During these exercises, the wheeled device is moved toward and away from the exerciser's hands, and the separation between the device and the hands is reduced and/or increased, each as a direct result of dynamic contractions of the low back extensors, hip flexors, hip extenders, and abdominal flexors.

When the device comes closer to the hands, usch as in FIGS. 12 and 13, the sharing of the load changes, to where the hands and arms may support approximately 20–80% of the body weight, while the legs via the device will support the balance. The angles of force directions also changes, such as the arms at the shoulders, adding to the effort of the exercise; and during all of these exercises, the exerciser must maintain the bridged support and his/her balance in the bridged support.

Another exercise one can do is to hand walk along the floor, one hand after the other, again with the body remaining in the bridged position (see FIGS. 19 and 20). In doing this, each arm alone momentarily supports all of the upper body weight, while the other hand is being repositioned forwardly or rearwardly of its original position. The laterally spaced wheels of the device provide for lateral stability of the exerciser, but the nonsymmetrical one arm support imposes a dynamic rotational moment and lateral flextion which the body must counteract by contracting additional torso muscles and/or by slightly bending side-to-side at the waist. Moreover, the shoulder and traperzius muscles, et. al., must be contracted to flex and extend each upper arm at the shoulder, momentarily passing through the position vertically aligned over the corresponding hand, to move the body either headwardly or footwardly. Border muscles of the shoulder blade are stressed during stabilization and gliding on the back ribs.

During hand walking, the stresses on the arm, back, abdonimal, and leg muscles are almost maximized, and the device is gruelling to operate for as short a time as a minute, stressing the body's anaerobic energy systems. This mode of exercise thus would be well suited for increasing muscle tone and endurance of a well-toned exerciser, such as wrestlers, football players, gymnasts etc.

The devices illustrated in FIGS. 4 and 5, 10, or 21–24, can be used with the exerciser "E" facing away from the support surface "S"; and his/her feet keyed within the device, with his/her heels generally adjacent the support surface and with his/her toes pointing upwardly. The most relaxed or starting bridged support position (not shown) might be where the exerciser's arms generally line up with the upper body and/or would be vertically disposed.

Figure 14:
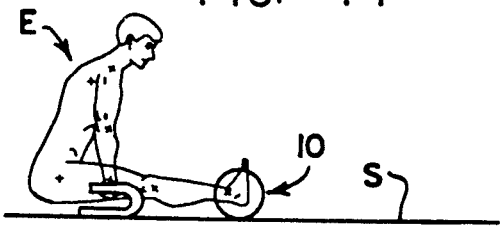
FIGS. 14–16 are elevational views of an exerciser using the device of FIGS. 4 and 5 according to different second modes of exercise.

From this basic bridged position, dynamic movement can come about by the exerciser forwardly flexing the upper arms at the shoulders and/or bending or flexing at the waist and/or hips to lift the legs, to assume the acute flag position of FIG. 14, where the upper body is angled out of the vertical and is on the side of the arms opposite from the feet carried on the device. This movement acts directly on the shoulders, arms abdominal and legs muscles. The position of FIG. 15 can come about by the exerciser rearwardly extending the upper arms at the shoulders and/or straightening at the waist and/or hips. The positions of FIGS. 14 and 15 can be held for a short count or possibly can only be reached when shifting dynamically from the opposite position of FIGS. 15 or 14. From the position of FIG. 15, the exerciser can bend or flex at the waist and/or hip joints and/or knees, to reach the position of FIG. 16.

Figure 15:
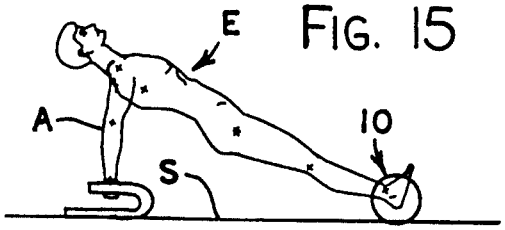
Figure 16:
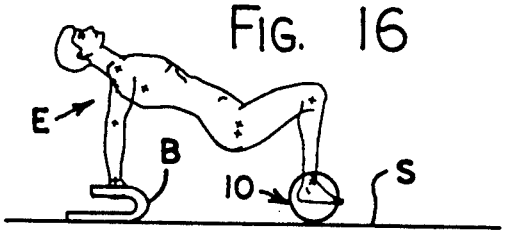
Figure 18:
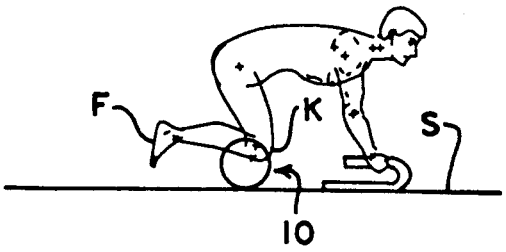
FIG. 18 is an elevational view of an exerciser using the device of FIGS. 7 and 8 according to still another mode of exercise.

Again, in any of the upwardly facing positions illustrated in FIGS. 14–16, the exerciser can walk on his/her hands, doubling the load the suporting arm holds; and stressing the muscles even more by forcing the bridged body to counteract the nonsymmertical distribution of forces created by the single arm support. Also, great effort is needed in the shoulders and upper arms to pull or push the wheeled device along on the support surface, either headwardly of footwardly; and the muscle stresses are dynamic, intense and repetitious, for effective toning of these muscles.

On the other hand, the device 10*k* (see FIGS. 6–8 and 18) can be used by a person of very poor muscle tone, as the bridged distance between the device and the hands is greatly reduced compared to the feet supported modes, and part of the feet and lower leg load is cantilevered beyond the device. Nonetheless, exercises both facing toward and away from the support surface can be performed with this device, with corresponding benefits; except the exercises will be much easier and thus could be done by a greater percentage of the population.

Figure 9:
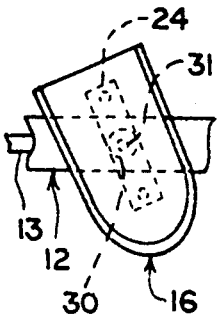
FIG. 9 is a view that corresponds to FIG. 4, except showing the shoe in an operative position rotated relative to the frame.

In the illustration of FIG. 17, the exerciser's feet in the device **10*h* of FIGS. 4, 5 and 9 are rotated to be somewhat aligned along the axle, with one foot now in front of the other, and the axle extended somewhat front to rear of the exerciser's upper body. The body now faces sideways, or parallel to the support surface "S", and the exerciser can assume the sideways bridged position: (1) on one arm, with the other being used for balance; or (2) on both arms (not shown) by twisting the body slightly to have the head-end face the support surface. The device of FIGS. 1–3** could also be used in this manner, except with the toes pointing downwardly slightly or being extended parallel to the support surface "S".

From this side-facing bridged position, the exerciser stresses the bulk of side control muscles (lower pectorial major, lattisimus doris, serratus anterior, etc.) rarely ever stressed, in just holding the bridge, and further of course in moving the exercise device toward and away from the supporting hand(s). Under these movements, these nonused muscles will not only be contracted or stressed, but the contraction will be under dynamic moving conditions, to provide great toning. The exercise, of course, can be done facing to the left, on the left arm (FIG. 17), and/or to the right, on the right arm (not shown). The device **10*r* of FIG. 10** can also be used for the side-facing exercises.

The exerciser "E" may do many different exercises from those illustrated, such as doing push-ups or hand-walking while in any of the positions illustrated in FIGS. 12–16; or can do the exercises illustrated in these figures while in a partial push-up position with the elbows bent.

While several embodiments of the invention have been illustrated, it is apparent that variations may be made therefrom without departing from the inventive concept. Accordingly, the invention is to be limited only by the scope of the following claims.

What is claimed as my invention is:

1. An exercise device, comprising the combination of a substantially unitary cross member;

a pair of wheels, and means rotatably connecting the wheels to the cross member adjacent its opposite ends, for rotation about an axis extended between the cross member ends, said wheels holding the cross member above a support surface in an unstable rotatable manner;

said cross member having first and second alternate pairs of separate feet-holding forms thereon, each pair of feet-holding forms being laterally spaced apart and between the wheels, and having transverse walls disposed between an imaginary cylinder defined between the wheel peripheries and the wheel axis and engaged below the wheel axis by the exerciser's feet to vertically support them on the cross member above the support surface;

each of said first pair of feet-holding forms also having walls extended upwardly aways from its transverse support wall and being open upwardly effective in modes of exercise with the exerciser generally facing toward the support surface to receive the toe-ends of the exerciser's feet and firmly hold them to the cross member and stablize the cross member on its wheeled support; and each of said second pair of feet-holding forms also having walls extended upwardly away from its transverse support wall and being open upwardly and rearwardly effective in modes of exercise with the execises generally facing away from the support surface to receive the heel-ends of the exerciser's feet and firmly hold them to the cross member and stabilize the cross member on its wheeled support;

whereby the exerciser can assume different bridged positions each generally having his/her hands on the support surface and his/her feet alternatively in the first or second pair of feet-holding forms of the exercise device, and whereby the exerciser can modify the bridged positions by moving at the waist, hips, knees, elbows and/or shoulders, with the hands being stationary or moving along the support surface and the exercise device moving along the support surface.

2. An exercise device according to claim 1, further including said first and second pairs of alternate feet-holding forms being on opposite front and rear sides of the cross member, relative to the wheel axis, to provide that the exerciser will be bridged in opposite directions away from the cross member, depending on which pair of feet-holding forms are used to hold his/her feet relative to the cross member.

3. An exercise device according to claim 1, further including releasable securing means connected to the cross member adjacent each of said second pairs of alternate feet-holding forms, to be secured over the exerciser's feet when in the second pair of feet-holding forms for holding the feet in said forms.

4. An exercise device according to claim 1, further including said wheels having equal diameters the general size of or less than the length of the exerciser's feet, providing that regardless of which pair of feet-holding forms are used to hold the toe-ends or the heel-ends of the exerciser's feet relative to the cross member, the opposite feet ends may project beyond the imaginary cylinder defined between the wheel peripheries and will be spaced from the support surface.

5. An exercise device according to claim 4, further including said first and second pairs of alternate feet-holding forms being on opposite front and rear sides of the cross member, relative to the wheel axis, to provide that the exerciser will be bridged in opposite directions away from the cross member, depending on which pair of feet-holding forms are used to hold his/her feet relative to the cross member.

6. An exercise device according to claim 4, further including releasable securing connected to the cross member adjacent each of said second pairs of alternate feet-holding forms, to be secured over the exerciser's feet when in the second pair of feet-holding forms for holding the feet in said forms.

7. An exercise device according to claim 5, further including releasable securing means connected to the cross member adjacent each of said second pairs of alternate feet-holding forms, to be secured over the exerciser's feet when in the second pair of feet-holding forms for holding the feet in said forms.

8. An exercise device according to claim 2, further including releasable securing means connected to the cross member adjacent each of said second pairs of alternate feet-holding forms, to be secured over the exerciser's feet when in the second pair of feet-holding forms for holding the feet in said forms.

* * * * *